US005611318A

United States Patent [19]

Kesler

[11] Patent Number: 5,611,318

[45] Date of Patent: Mar. 18, 1997

[54] AUTOMOTIVE IGNITION SYSTEM LOCKUP PROTECTION CIRCUIT

[75] Inventor: Scott B. Kesler, Kokomo, Ind.

[73] Assignee: Delco Electronics Corporation, Kokomo, Ind.

[21] Appl. No.: 454,480

[22] Filed: May 30, 1995

[51] Int. Cl.[6] ..... F02P 11/00

[52] U.S. Cl. ..... 123/630; 315/119

[58] Field of Search ..... 123/630, 632, 123/146.5 D; 361/35, 86, 89; 315/119

[56] References Cited

U.S. PATENT DOCUMENTS

| | | | |
|---|---|---|---|
| 4,106,460 | 8/1978 | Kopera | 123/632 |
| 4,368,717 | 1/1983 | Roberts et al. | 123/632 |
| 4,774,925 | 10/1988 | Iwata | 123/632 |
| 5,143,553 | 9/1992 | Mukaihira et al. | 123/632 |

*Primary Examiner*—Andrew M. Dolinar
*Attorney, Agent, or Firm*—Jimmy L. Funke

[57] ABSTRACT

An automotive ignition system lockup protection circuit utilizes a capacitor charging/discharging circuit to generate a periodic clock signal. A counter circuit activates an ignition coil deenergizing signal after a predetermined number of clock signal. The capacitor charges and discharges within a voltage reference window defined as the difference between a first reference voltage and a second larger reference voltage, wherein the first reference voltage is functionally related to a variable battery voltage and the second reference voltage is fixed and independent of battery voltage. The frequency of the periodic clock signal is modulated in accordance with the voltage reference window to thereby vary the lockup time in accordance with battery voltage. The capacitor charging and discharging current is adjustable to compensate for variations in the capacitor value and the entire circuit operates consistently over a temperature range typically required in an automotive application.

24 Claims, 5 Drawing Sheets

10
32
DRIVE INHIBIT
COUNTER
DR
24
DR
F1
Q
$\overline{Q}$
S
R
V c1
V cc
I chg
2 X I chg
30
28
V cap
CAP 1
18
20
C1
22
C2
V cc
V ref 1
V preset
V ref 2
12
16
14
BATTERY
REFERENCE VOLTAGE GENERATOR #1
CAPACITOR VOLTAGE PRESET
REFERENCE VOLTAGE GENERATOR #2
26
DRIVE
DRIVE V batt = 14V
Vref2
Vpreset
Vref1
t(ms)
0
10
20
30
40
50
60
70
80
90
3.8
2.8
2.6
1.0
0
1.0
0
1.0
0
1.0
0
5.0
0
V cap (V)
DRIVE (V)
S (V)
R (V)
Ø1 (V)
DRIVE INHIBIT (V)
34
35
36
37
38
39

90
VCC
Iref
92
IC4
Q5
Ix
Rtrim
(EXTERNAL)
94
96
98
R3
IC3
Q4
100
Ix
106
Q11
Q12
108
Ichg
102
Q6
Q7
Ix
104
DRIVE
28
2 X Ichg
Q8
110
Q10
114
$\overline{Q}$
30
2 X Ichg
112
Q9
18
CAP1
Ichg

AUTOMOTIVE IGNITION SYSTEM LOCKUP PROTECTION CIRCUIT

FIELD OF THE INVENTION

The present invention relates generally to circuitry for providing automotive ignition system lockup protection, and more specifically to such circuitry wherein lockup time is dependent upon battery voltage, and wherein consistent circuit operation is maintained over a wide temperature range typically encountered in an automotive environment.

BACKGROUND OF THE INVENTION

In the past few decades, the automotive industry has experienced a tremendous proliferation in both the number and types of vehicular functions and systems subject to computer control. As an example of one such system, a modern engine ignition system typically includes an ignition coil, a coil current switching device responsive to an ignition, or "drive", signal to energize the ignition coil, and some type of microprocessor-controlled circuitry to provide the drive signal to the ignition coil.

One consequence of such computer control is the possibility of a failure or fault condition associated therewith. If proper anticipatory measures are not taken, certain potential fault conditions can lead to undesirable, and often damaging, results. For example, one possible fault condition in an automotive ignition system may occur when the drive signal input to the ignition system remains on for an excessively long time period. Under such a fault condition, the coil current switching device may be damaged by high temperatures resulting from continuous, and prolonged, conduction of coil current.

To prevent such damage, it is desirable to limit the length of time that the ignition coil current is permitted to flow. However, since potentially damaging temperatures, due to an excessive duration drive signal, are a function of the battery voltage, less heat is generated as the battery voltage decreases. Thus, the maximum coil current flow time, or "lockup" time, should ideally increase as battery voltage decreases. What is therefore needed is an automotive ignition system lockup protection circuit wherein the lockup mime is inversely proportional to battery voltage. Such a lockup protection circuit should further operate consistently over a temperature range typically required in an automotive application, such as between approximately–40 degrees and 160 degrees Celsius (C).

SUMMARY OF THE INVENTION

According to one aspect of the present invention, an ignition system protection circuit comprises a first circuit responsive to a variable level power input voltage to provide a first reference signal corresponding to a percentage thereof, a second circuit providing a fixed second reference signal greater than the first reference signal, a third circuit responsive to an ignition coil energizing signal, the first reference signal and the second reference signal to provide a periodic clock signal having a frequency dependent upon the difference between the second reference signal and the first reference signal, and a fourth circuit responsive to a number of the clock signals to provide an ignition coil deenergizing signal.

According to another aspect of the present invention, an ignition system protection circuit comprises a first circuit responsive to a variable level power input voltage to provide a first reference voltage corresponding to a percentage thereof, a second circuit providing a fixed second reference signal greater than the first reference voltage, a third circuit responsive to a periodic clock signal to provide a correspondingly periodic charging and discharging current, and a capacitor responsive to the periodic charging and discharging current to provide a correspondingly periodic increasing and decreasing capacitor voltage. A first comparator is responsive to the first reference voltage and the capacitor voltage to provide a first switching signal. Similarly, a second comparator is responsive to the second reference voltage and the capacitor voltage to provide a second switching signal. A fourth circuit is responsive to the first and second switching signals to provide the periodic clock signal to the third circuit, wherein the periodic signal has a frequency dependent upon the difference between the second reference voltage and the first reference voltage. Finally, a fifth circuit is responsive to a number of the periodic clock signals to provide an ignition coil deenergizing signal.

According to a further aspect of the present invention, a method of protecting an automotive ignition system from prolonged conduction of current from a variable-power voltage source through an ignition coil of the system due to a prolonged ignition coil energizing signal comprises the steps of: (1) sensing the ignition coil energizing signal, (2) delaying a variable time period after sensing the ignition coil energizing signal, wherein the variable time period increases in duration as the voltage from the variable-power source decreases, and (3) generating an ignition coil deenergizing signal at the end of the variable time period to inhibit further conduction of current from the variable-power source through the ignition coil of the system.

One object of the present invention is to provide a circuit for providing automotive ignition system lockup protection wherein the lockup time depends upon the magnitude of battery voltage.

Another object of the present invention is to provide an automotive ignition system lockup protection circuit that operates consistently over a temperature range typically required in an automotive application, such as between–40 degrees C. and 160 degrees C.

A further object of the present invention is to provide an automotive ignition system lockup protection circuit utilizing a capacitor charge/discharge arrangement to generate a clock signal wherein the capacitor charge/discharge current may be adjusted to compensate for variations in the capacitor value.

Yet another object of the present invention is to provide an automotive ignition system lockup protection circuit utilizing a capacitor charge/discharge arrangement to generate a clock signal wherein the capacitor voltage is preset to a known starting voltage level.

These and other objects of the present invention will become more apparent from the following description of the preferred embodiment.

DESCRIPTION OF THE PREFERRED EMBODIMENT

Figure 1:
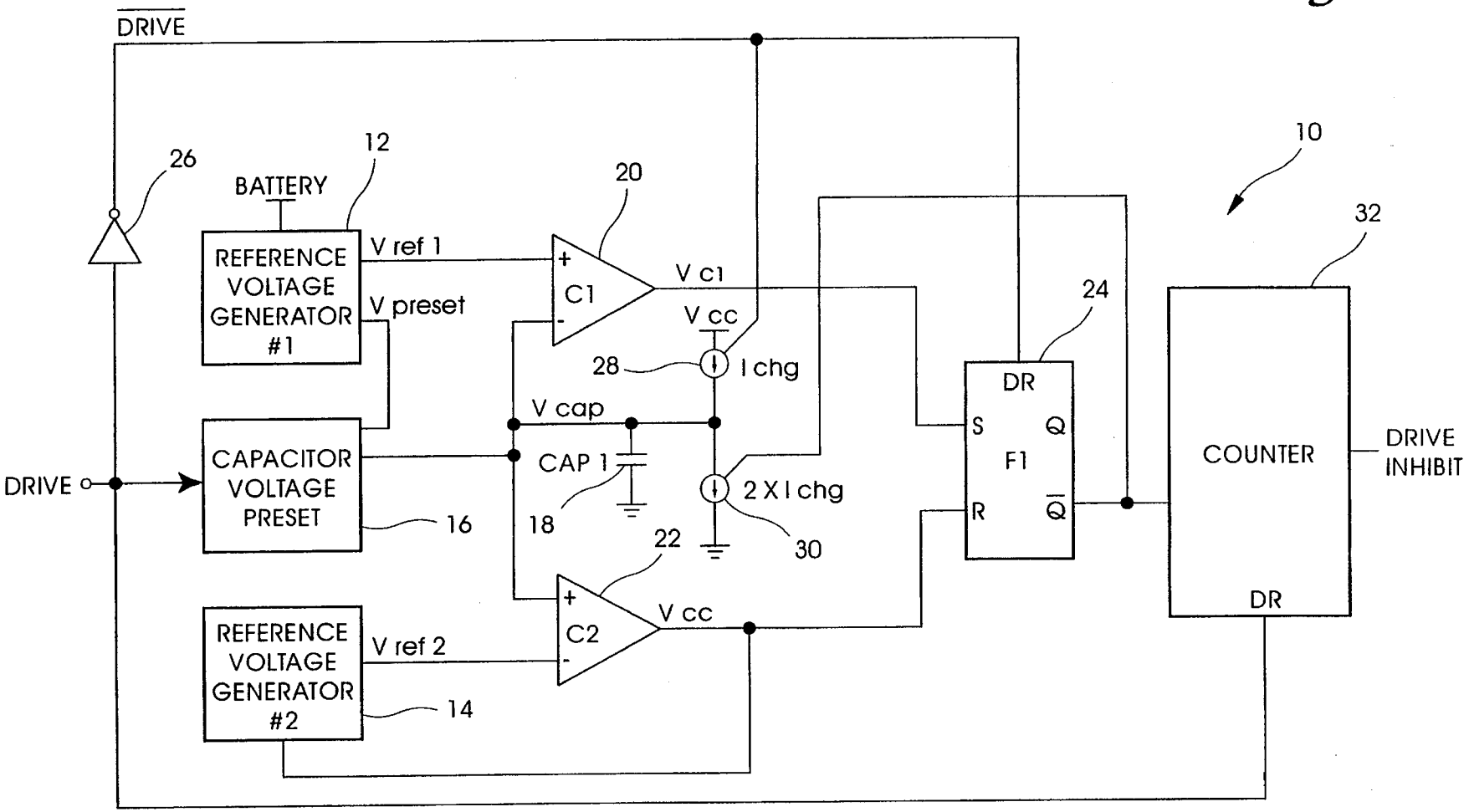
FIG. 1 is a functional block diagram showing one embodiment of the automotive ignition system lockup protection circuit of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a block diagram of an automotive ignition system lockup protection circuit 10, in accordance with the present invention, is shown. A reference voltage generator 12 is connected to battery voltage and provides a voltage "Vref1" which is a function of the battery voltage. A second reference voltage generator 14 provides a fixed voltage "Vref2" which is independent of battery voltage. A capacitor voltage preset circuit 16 has an input for receiving a voltage "Vpreset" from reference voltage generator 12 and is operable to impress Vpreset across capacitor 18 under normal operation of the automotive ignition system (not shown). As will be more fully described hereinafter, the capacitor voltage preset circuit 16 is further responsive to an ignition coil energizing signal (hereinafter "drive" signal) to disable circuit 16 from maintaining the voltage Vpreset across capacitor 18, so that the voltage Vcap across the capacitor 18 periodically charges and discharges.

A first comparator 20 has a non-inverting input connected to Vref1 and an inverting input connected to Vcap. Similarly, a second comparator 22 has a non-inverting input connected to Vcap and an inverting input connected to Vref2. The output of the first comparator 20, "Vc1", is provided to a "set" input of flip-flop 24, and the output of the second comparator 22, "Vc2", is provided to a "reset" input of flip-flop 24. Output Vc2 is further fed back to reference voltage generator 14, the purpose of which will be discussed hereinafter with respect to FIG. 4.

The specific circuit componentry of comparators 20 and 22 do not form an important aspect of the present invention and may therefore comprise any known comparator embodiment. Similarly, flip-flop 24 may comprise any known RS-type flip-flop embodiment, although those skilled in the art will recognize that other types of flip-flops, such a J–K, D, and the like, may be substituted therefore with minor modifications to circuit 10.

The drive signal is inverted by invertor 26 and provided to a drive reset input of flip-flop 24. The drive reset input (DR) of flip-flop 24 acts as a type of master flip-flop reset in that it ensures that flip-flop 24 starts in a known state when circuit 10 receives a drive signal. Similarly, the inverted drive signal is provided to capacitor charging current source 28 to activate the current source 28 when circuit 10 receives a drive signal.

Capacitor charging current source 28 is connected to capacitor 18 and, when activated, supplies a charging current "Ichg" to thereby charge capacitor 18. A capacitor discharging current source 30 is also connected to capacitor 18 and to the Qbar output of flip-flop 24. When the Qbar output of flip-flop 24 switches to a logic low to a logic high, capacitor discharging current source 30 draws a current "2XIchg"from capacitor 18, thereby discharging capacitor 18 at the same rate at which it was charging when the Qbar output of flip-flop 24 was a logic low.

Finally, the Qbar output of flip-flop 24 is connected to a counter 32. Counter 32 is operable to count a predetermined number of Qbar logic level transitions and thereafter activate a "drive inhibit" output signal. Counter 32 further includes a drive reset input (DR) connected to the drive signal to thereby maintain counter 32 at a zero count (reset condition) prior to activation of the drive signal. Preferably, counter 32 counts four falling edges of Qbar and thereafter provides a logic high level at drive inhibit. However, the present invention contemplates that counter 32 may be provided to count any desired number of Qbar logic level transitions, and further to count either rising or falling edge Qbar transitions, prior to activating the drive inhibit output signal. As with comparators 20 and 22, and flip-flop 24, counter 32 may comprise known circuitry. Circuit 10 of FIG. 1 is intended to have an application in an automotive ignition system (not shown) to prevent the ignition coil from conducting current for a prolonged period of time due to a fault condition wherein the drive signal (ignition coil energizing signal) remains on for an excessive time period. Circuit 10 is further intended to be implemented in integrated circuit form, preferably silicon. The operation of circuit 10 in such an automotive ignition system will now be described in detail with reference to the block diagram of FIG. 1 and the corresponding timing diagram of FIG. 2.

The ignition system protection circuit 10 is initialized during the time that the ignition coil current is off. Prior to receiving an ignition coil energizing (drive) signal ($t<0$), drive 35 is a logic low level which keeps counter 32 in a reset state (count=0) so that drive inhibit is a logic low level. The inverted drive signal, on the other hand, is a logic high level which disables capacitor charging current source 28 and maintains flip-flop 24 in a state such that Qbar 38 is a logic high level, thus disabling capacitor discharging current source 30. The logic low drive signal further activates capacitor voltage preset circuit 16 which impresses the voltage Vpreset, a voltage level slightly above Vref1 but less than Vref2, on the capacitor 18 as Vcap 34. In the timing diagram shown in FIG. 2, Vref1=2.6 volts, Vpreset=2.8 volts and Vref2=3.8 volts. Thus in the steady state prior to a drive signal, Vref1<<Vcap<Vref2 (Vcap. =2.8 volts), Qbar=logic high level, and counter 32 is in reset (count=0).

When the ignition coil current is switched on, drive 35 switches from a logic low level to a logic high level ($t=0$), thus enabling counter 32 to count falling edges of Qbar 38, enabling flip-flop 24 to change state, disabling capacitor voltage preset circuit 16 and enabling capacitor charging current source 28. Since Vcap>Vref1 at $t<0$, Vc1 is low so that "set", hereinafter S 36, of flip-flop 24 is a logic low level. Similarly, Vref2>Vcap at $t<0$ so that Vc2, and hence "reset", hereinafter R 37, of flip-flop 24 is also a logic low level. Thus, upon receiving a logic high level drive signal 35 at $t=0$, flip-flop 24 will not change state and capacitor 18 will begin to charge under the influence of capacitor charging current source 28.

When Vcap 34 increases to a level above that of Vref2, the output Vc2 of comparator 22 switches logic states so that R 37 switches to a logic high level. The switching of R 37 to a logic high level then causes Qbar 38 of flip-flop 24 to switch to a logic low state. The high to low transition of Qbar has two effects. First, the counter 32 detects the falling edge of Qbar 38 and advances the count from 0 to 1. Second, the logic low level of Qbar 38 activates the capacitor discharging current source 30. Although the capacitor charging current source 28 is still supplying a current Ichg to capacitor 18, the capacitor discharging current source 30 is now drawing a current 2XIchg (equal to twice the current Ichg) from capacitor 18. The net effect of the simultaneous operation of current sources 28 and 30 is that the capacitor 18 begins to discharge at substantially the same rate that it was charging under the influence of current source 28 alone. As Vcap 34 falls below Vref2, R 37 switches back to a logic low level. However, since S 36 is also a logic low level, Qbar 38 does not change state.

When Vcap 34 decreases to a level below Vref1, the output Vc1 of comparator 20 switches logic states so that S 36 switches to a logic high level. The switching of S 36 to a logic high level then causes Qbar 38 to switch to a logic high level, thus disabling capacitor discharging current source 30. Since capacitor 18 is now only subject to capacitor charging current source 28, capacitor 18 begins to charge again. As Vcap 34 increases above Vref1, S 36 switches back to a logic low level. Again, since R 37 is also a logic low level, Qbar 38 does not change state.

Figure 2:
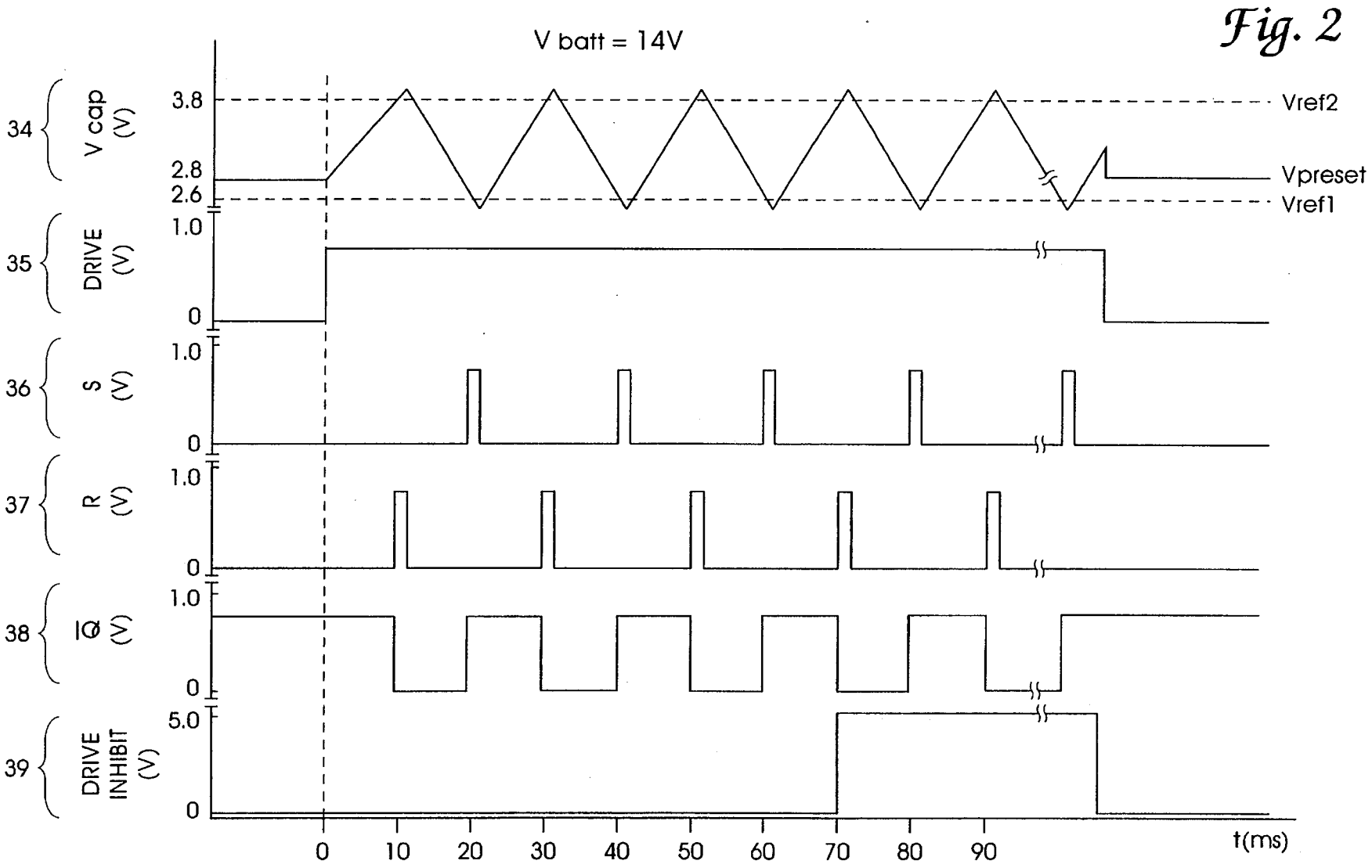
FIG. 2 is a timing diagram showing typical operation of the automotive ignition system lockup protection circuit of FIG. 1 for a battery voltage of approximately 14 volts.

The foregoing capacitor charge/discharge cycle is periodically repeated until either the ignition coil switches off, thus switching drive 35 to a logic low level, or counter 32 detects four falling edges of Qbar 38. If drive 35 switches to a logic low level prior to the occurrence of four falling edges of Qbar 38, all signals 34–39 are forced to their pre-drive state (t<0). If counter 32 counts four falling edges of Qbar 28 prior to drive 35 switching back to a logic low level, then an abnormal drive 35 condition is detected and drive inhibit 39 switches to a logic high level. Although not shown in FIG. 1, a logic high level drive inhibit 39 is intended to switch off the ignition coil to inhibit further conduction of current therethrough. As shown in FIG. 2, when drive 35 thereafter returns to a logic low level, all signals 34–39 are forced to their pre-drive state (t<0).

Figure 3:
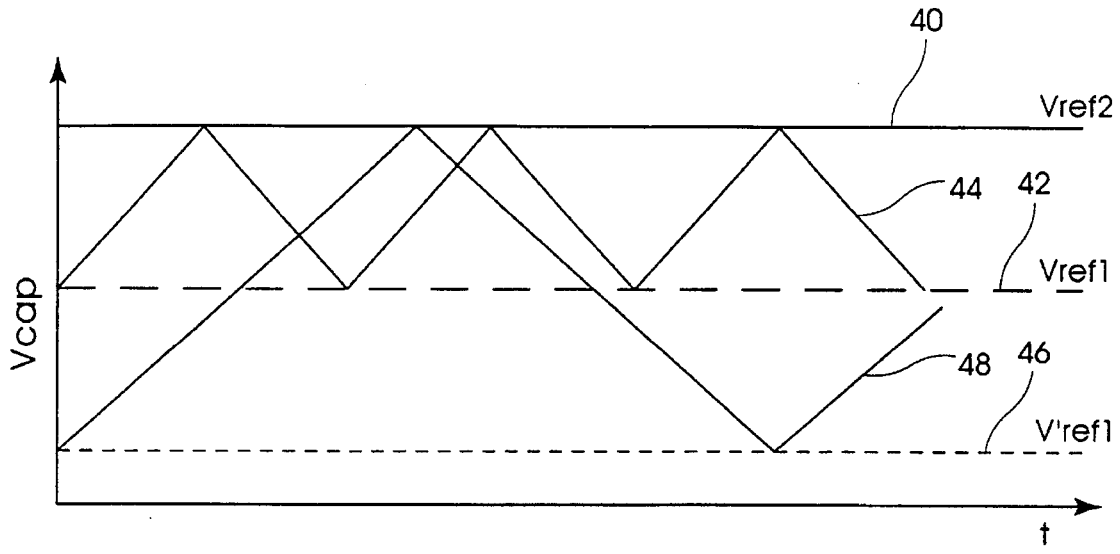
FIG. 3 is a plot of capacitor voltage over time for the capacitor Cap1 of FIG. 1, illustrating the difference in charge and discharge times between two voltage reference windows.

Since potentially damaging temperatures, due to an excessive duration drive signal, are a function of the battery voltage, the amount of time that the ignition coil current is permitted to flow should be dependent upon the voltage level of the battery or alternative power source supplying current to the ignition coil. To accomplish this feature, the voltage reference generator 12 is designed to vary as a function of battery voltage. Referring now to FIG. 3, this concept is illustrated with the aid of a plot of the capacitor 18 voltage Vcap over time for two sets of reference voltages while Ichg and 2XIchg remain constant. Between a fixed Vref2 40 value and voltage reference Vref1 42, Vcap 44 has a frequency almost three times greater than that of Vcap 48 established between Vref2 40 and Vref'46. Thus, the frequency, and therefore period, of Vcap is determined in large part upon the difference between the reference voltages Vref2 and Vref1. In the circuit 10 of FIG. 1, Vref2 is maintained constant while Vref1 is modulated by battery voltage to thereby control the capacitor 18 charge/discharge time period.

In accordance with a preferred embodiment of the present invention, a lockup time of approximately 300 milliseconds is required for a battery voltage of 6 volts, while a lockup time of approximately 75 milliseconds is required for a battery voltage of 14 volts. In this embodiment, the ratio of the lockup times (4:1) is not equal to the ratio of the battery voltages (3:7). Accordingly, reference voltage generator 12 is designed to provide a reference voltage Vref 1 having a magnitude that varies in a non-proportional manner with battery voltage, as will be more fully discussed with reference to FIG. 4. It is to be understood, however, that the present invention contemplates alternate embodiments of reference voltage generator 12 providing a reference voltage Vref1 having a magnitude that varies proportionally with battery voltage, such as a percentage thereof. Such a reference voltage generator is considered to be within the spirit of the present invention and those skilled in the art will recognize that only minor modifications to the circuitry described herein are required to achieve such a proportional relationship.

Figure 4:
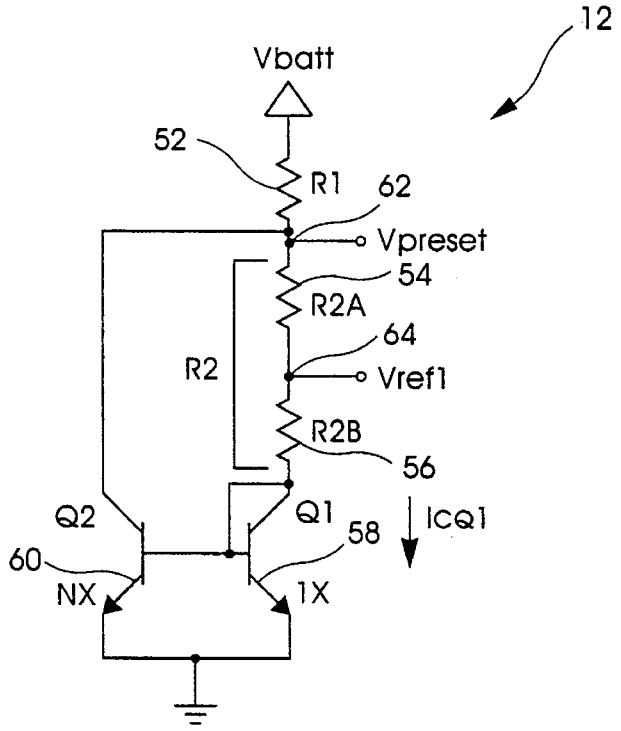
FIG. 4 is a schematic diagram of the Reference Voltage Generator #1 circuit shown in FIG. 1.

Referring now to FIG. 4, a preferred embodiment of reference voltage generator 12, wherein the voltage Vref1 varies non-proportionally with battery voltage, is shown. Reference voltage generator 12 includes a resistor R1 52 having one end connected to battery voltage or, alternatively, to a variable level power supply which supplies current to the coil of the ignition system (not shown). The opposite end of R1 52 is connected to one end of a second resistor R2A 54 and to a collector of an NPN transistor Q2 60. The connection between R1 52 and the parallel combination of R2A 54 and Q2 60 defines a node 62 from which the voltage Vpreset is supplied. The opposite end of R2A 54 is connected to one end of a third resistor R2B 56, and the connection therebetween defines a node 64 from which the voltage Vref1 is supplied. The opposite end of R2B 56 is connected to the collector (and base) of a diode connected NPN transistor Q1 58 which, in turn, is connected to the base of Q2 60 to form a current mirror therebetween.

The voltage drop across R1 52 is determined by a combination of the voltage division of battery voltage (Vbatt) across R1 52, R2A 54 and R2B 56 in series with the diode connected transistor Q1 58, and the additional current drawn across R1 52 by the NPN current mirror composed of Q1 58 and Q2 60. As previously discussed, Vpreset is ideally set slightly greater than Vref1 so that R2A<<R2B. The additional current from Q2 60 provides the offsetting voltage across R1 52 that causes Vref1 to vary at a rate different than that of Vbatt. Generally, Vref1 is a function of Vbatt, R1 52, R2A 54, R2B 56, the Vbe of Q1 58 and the ratio N of Q2's emitter area to Q1's emitter area. Since reference voltage generator 12 is to be implemented as a silicon integrated circuit, each of the silicon resistors 52–56 have a characteristic temperature coefficient associated therewith such that the resistance increases with increasing temperature. The resulting temperature coefficient of Vref1, however, will have a negative temperature coefficient due to the dominant characteristic negative temperature coefficient of the Vbe of Q1 58. Within the temperature range of interest (–40 degrees C.–160 degrees C), the Vbe of Q1 60 as well as the resistors 52–56 exhibit a nearly linear temperature coefficient so that the temperature coefficient of the resulting Vref1 voltage will similarly be nearly 35 linear.

Resistors R1 52, R2A 54, R2B 56 and the emitter ratio N are chosen such that the difference between Vref2 and Vref1, as a function of Vbatt, varies in the ratio defined by the required lockup times previously discussed. Thus, as Vbatt varies from a minimum battery voltage of 6 volts to a maximum battery voltage of 14 volts, the difference between Vref2 and Vref1 should vary in a ratio of 4:1, corresponding to lockup times of approximately 300 milliseconds and 75 milliseconds respectively. Through the simultaneous and iterative solution of equations describing reference voltage generator 12, wherein such equations utilize circuit component definitions and relationships well known to those skilled in the art, the following values have been determined to achieve the foregoing ratio: R1 52=15.325 kohms, R2A 54=200 ohms, R2B 56=3.475 kohms, and N=0.5 so that Q1 58 has an emitter area approximately twice the size of the emitter area if Q2 60. With the foregoing component values, Vref1=2.879 volts (approximately) and Vpreset=2.975 volts (approximately) at Vbatt=14 volts, and Vref1=1.562 volts (approximately and Vpreset=1.6 volts (approximately) at Vbatt=6 volts, wherein each Vref1 value occurs at room temperature (27 degrees C).

Figure 5:
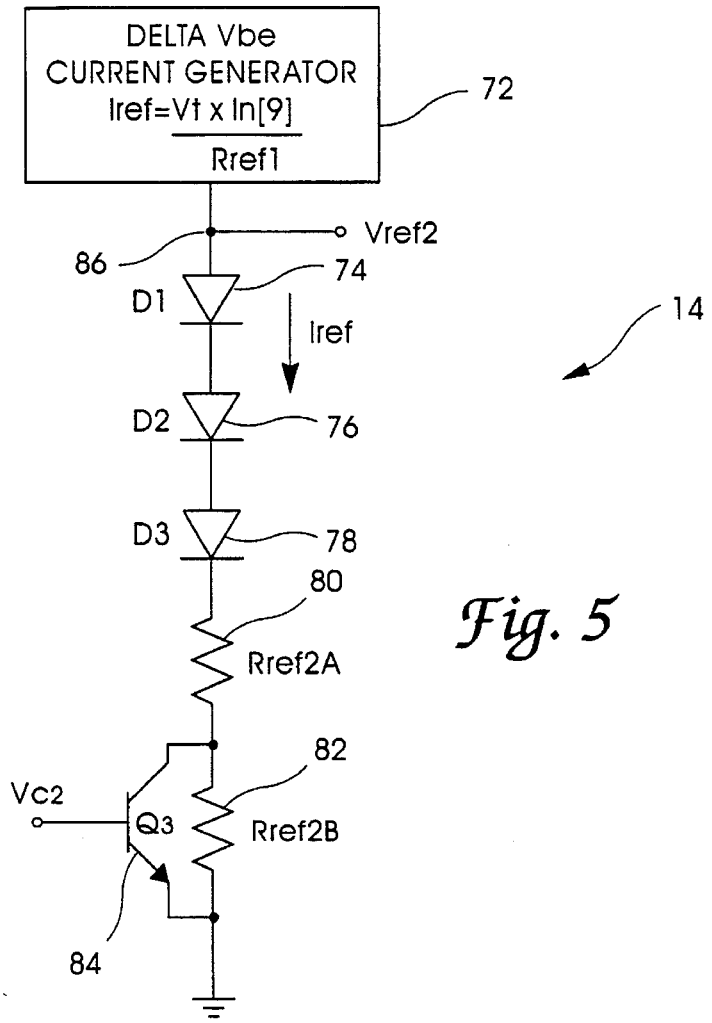
FIG. 5 is a schematic diagram of the Reference Voltage Generator #2 circuit shown in FIG. 1.

Referring now to FIG. 5, a preferred embodiment of reference voltage generator 14, wherein the voltage Vref2 is fixed (independent of Vbatt), and has approximately the same negative temperature coefficient as Vref1, is shown. By having substantially identical temperature coefficients, the difference between Vref2 and Vref1, over the temperature range of interest, should thereby remain substantially constant.

Reference voltage generator 14 includes a reference current generator 72 connected in series with three diodes (diode connected NPN transistors) D1 74, D2 76 and D3 78, which are in turn connected in series with two resistors 35 Rref2A 80 and Rref2B 82. An NPN transistor 84 is connected across Rref2B 82 and has its base connected to the output Vc2 of comparator 22. The connection between reference current generator 72 and diode D1 74 defines a node 86 from which the voltage Vref2 is supplied.

Reference current generator 72, in a preferred embodiment, is a "delta Vbe" current generator, commonly known to those skilled in the art. The details of such a reference current generator will therefore not be shown in detail, although it is to be understood that reference current generator 72 includes a resistor Rref1 and an appropriate ratioing of transistor emitter areas, so that the reference current is defined by the standard delta Vbe current equation Iref=Vt*ln(9)/Rref1. Vt is known as the "thermal voltage" and is defined by the equation Vt=k*T/q, wherein k is Boltzmann's constant, T is the temperature in degrees Kelvin, and q is the electronic charge. The present invention contemplates that other internal emitter area ratios may be used so that, generally speaking, the numeral "9" in the foregoing equation may be replaced with a constant "K". Although Rref1 has a positive temperature coefficient characteristic of a silicon resistor, Iref generally has a positive temperature coefficient due to the strong increasing temperature dependence of the Vt term.

When the reference current Iref is forced onto the series combination of the three diodes 74–78 and resistors 80 and 82, Vref2 is defined by the equation Vref2 =Iref * (Rref2A +Rref2B) +3Vd, wherein Iref is defined as above and Vd is the diode voltage drop for each of the three diodes 74–78. Diodes 74–78 are composed of diode connected NPN transistors so that the diode voltage drop is simply the Vbe of the corresponding diode connected transistor. Although Vbe generally has a negative temperature coefficient, the overall temperature coefficient of Vref2 is generally positive due to the strong positive temperature coefficient of Iref. However, the actual temperature coefficient of 35 Vref2 may be modulated through the choice of resistor values for Rref1, Rref2A 80 and Rref2B 82. Preferably, Rref1, Rref2A 80, and Rref2B 82 are chosen so that the resulting temperature coefficient of Vref2 substantially matches that of Vref1.

Given the temperature coefficient slope of Vref1, as well as the Vref2–Vref1 ratio requirements, a series of equations involving well-known circuit relationships are solved to determine the foregoing resistor values. Specifically, Rref1= 338.8 ohms and Rref2A +Rref2B=6.818 kohms. With the foregoing resistor values, Vref2=3.517 volts (approximately), at room temperature (27 degrees C.). Thus, at Vbatt=6 volts, Vref2–Vref1=1.755 volts, and at Vbatt=14 volts, Vref2–Vref1=0.438 volts, resulting in a ratio of 4:1.

Although 3 diodes 74–78 are utilized in a preferred embodiment, the present invention contemplates other Vref2 –Vref1 requirements wherein any number of diodes may be stacked to provide a Vbatt independent reference voltage Vref2. Those skilled in the art will recognize that only slight modifications to the resistor values are required to achieve other Vref2 –Vref1 requirements while maintaining the Vref2 temperature coefficient substantially identical to the Vref1 temperature coefficient.

With the Vref1 and Vref2 arrangement described thus far, the operation of circuit 10 proceeds as described for battery voltages of between 6 volts and 14 volts. However, it is not uncommon in an automotive environment to experience normal operation with battery voltages in excess of 14 volts. In such a situation, Vref1 tends to increase to a value greater than Vref2 as Vbatt approaches approximately 16 volts. To compensate for this effect, transistor Q3 84 is connected to the output Vc2 of comparator 22 to effectively short circuit Rref2B when Vc2 is switched to a logic high level, thereby momentarily decreasing the level of Vref2. This feature then causes the capacitor voltage Vcap to oscillate between the two Vref2 levels to thereby establish a minimum lockup time for battery voltages in excess of 16 volts. However, as Vbatt increases above 16 volts, lockup time increases slightly due to the extra time it takes for the capacitor 18 to charge from Vpreset to the upper Vref2 reference voltage. In any event, at battery voltages below 16 volts, the effect of Q3 84 does not appreciably affect lockup time if Rref2B is chosen to have a value sufficiently less than Rref2A. It has been determined through experimentation that optimum values for resistors 80 and 82 are, Rref2A=4.818 kohms and Rref2B =2.0 kohms.

The ignition system protection circuit 10, as previously discussed is intended to be implemented as a silicon integrated circuit. However, capacitor 18 is intended to be provided as an external component to circuit 10. As such, it is desirable to provide an arrangement, also external to circuit 10, for adjusting the capacitor 18 charging and discharging currents Ichg and 2XIchg to compensate for variations in the external capacitor value.

Figure 6:
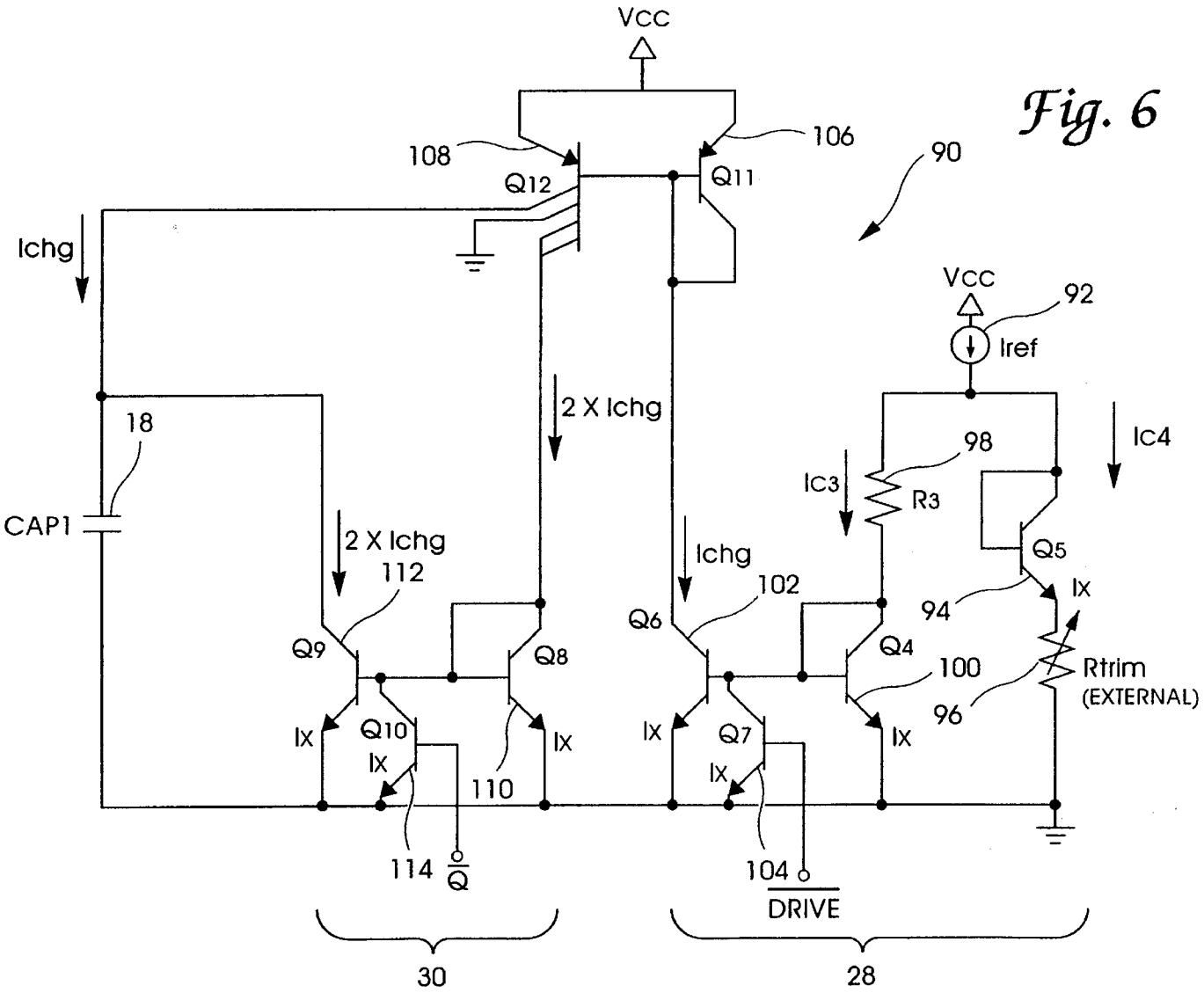
FIG. 6 is a schematic diagram of the Cap1 charging/discharging circuit (Ichg and 2XIchg) shown in FIG.

Referring now to FIG. 6, a circuit 90 is shown which incorporates capacitor charging current source 28 and capacitor discharging current source 30, and further provides circuitry for performing the foregoing charging and discharging current adjustment function. Circuit 90 includes a reference current generator 92, identical to reference current generator 72 of FIG. 5, which is connected to the parallel combination of diode connected NPN transistor Q5 94 in series with resistor Rtrim 96 and resistor R3 98 in series with diode connected NPN transistor Q4 100. NPN transistor Q6 102 is connected to Q4 98 to form a current mirror therebetween. NPN transistor Q7 104 is connected between the base of Q4 98/Q6 102 and ground, and has a base connected to the inverted drive signal. The current Ichg flows through Q6 102, and through diode connected PNP transistor Q11 106 which is connected in series with Q6 106. PNP transistor Q12 108 is connected to Q11 106 to form a current mirror therebetween. Q12 108 is preferably a 4-collector transistor with one collector grounded and one collector connected to capacitor 18 to supply the mirrored current Ichg thereto. The remaining two collectors of Q12 108 are tied together and connected to diode connected NPN transistor Q8 110 to thereby supply a current 2XIchg thereto which is effectively double the value of Ichg. An NPN transistor Q9 112 is connected to Q8 110 to form a current mirror therebetween, with the collector of Q9 112 connected to capacitor 18. Finally, an NPN transistor Q10 114 is connected between the base of Q9/Q10 and ground, with the base of Q10 114 being connected to Qbar of flip-flop 24.

The operation of circuit 90, with respect to the ignition system protection circuit 10 of FIG. 1, will now be described in detail. Prior to receiving a drive signal (t<0 in FIG. 2), Qbar 38 and drive bar (inverse of 35) are both logic high levels, thus turning on transistors Q7 104 and Q10 114. Turning on Q7 104 and Q10 114 disables the current mirrors formed by Q4/Q6 and Q8/Q9 respectively, so that neither Ichg nor 2XIchg flows as previously described. When drive 35 switches to a logic high level (so that drive bar switches to a logic low level), the current Ichg flows through Q6, the Q11/Q12 current mirror and into capacitor 18 thereby causing it to charge. When Qbar 38 switches to a logic low level, as previously discussed, the Q8/Q9 current mirror is also activated. However, although Q12 108 continues to supply the current Ichg to capacitor 18, Q9 draws a current 2XIchg from capacitor 18. The net effect is that a current substantially equal to Ichg is drawn away from capacitor 18 thereby causing it to discharge at approximately the same rate at which it was previously charging.

The current Ichg is established by the current Ic3 flowing through resistor R3 98 and diode connected transistor Q4 100, which is, in turn, established by the reference current generator 92. In operation, Iref is split between R3 98 and Rtrim 96, where R3 98 is preferably a silicon diffused resistor having a positive temperature coefficient, and Rtrim is an external adjustable resistor with negligible temperature coefficient (or at least negligible relative to the temperature coefficient of R3 98). In a preferred embodiment, Rtrim 96 is a trimmable resistor, such as by laser trimming, to thereby increase the value of Rtrim. However, the present invention contemplates that Rtrim may further be (or alternatively be) of the type that the resistance of Rtrim may be incrementally increased. Such a resistor may comprise, for example, a series of resistors having laser-fusible links therebetween which, when fused, add incremental resistance values to Rtrim 96. In any event, increasing Rtrim 96 has the effect of increasing the current Ichg, and therefore the current 2XIchg, to compensate or variations in the value of capacitor 18.

The presence of Q5 94 in series with Rtrim 96 effectively compensates for the temperature coefficient of Q4's Vbe. As temperature increases, the value of R3 98 increases at the same rate as the resistor R1 in the Iref generator 92. Since Rtrim 96 has a negligible temperature coefficient, the value of Rtrim 96 does not correspondingly increase with temperature. Increasing temperature thus has the effect of decreasing the impedance of the Rtrim/Q5 series connection as compared to the R3/Q4 series combination. This slight decrease in impedance compensates for the normal positive temperature coefficient in the current Iref (as previously discussed), and thereby compensates for the modulation of Ichg with temperature that would otherwise result from the change in Q4's Vbe with temperature as well as the change in Iref with temperature. Circuit 90 thus permits adjustment of the capacitor charging and discharging currents Ichg and 2XIchg without introducing an additional temperature coefficient in the two currents.

Utilizing equations for circuit 90 involving known component and circuit relationships, R3 98 has been determined to be approximately 10 kohms, and Rtrim has been determined to require an initial value of approximately 700 ohms. With the circuit components so determined, and with the trimming capability of Rtrim 96, Ichg may range between approximately 17 microamps and 160 microamps. Given the foregoing information, known circuit component and circuitry relationships may be used to determine a capacitance value for capacitor 18 in order to achieve the required lockup times. With a slight adjustment in the current Ichg so that Ichg=20 microamps (approximately), capacitor 18 has a value of approximately 0.1 microfarads. It is to be understood, however, that other capacitor values may be used to achieve similar results, with a corresponding change in the current Ichg.

Figure 7:
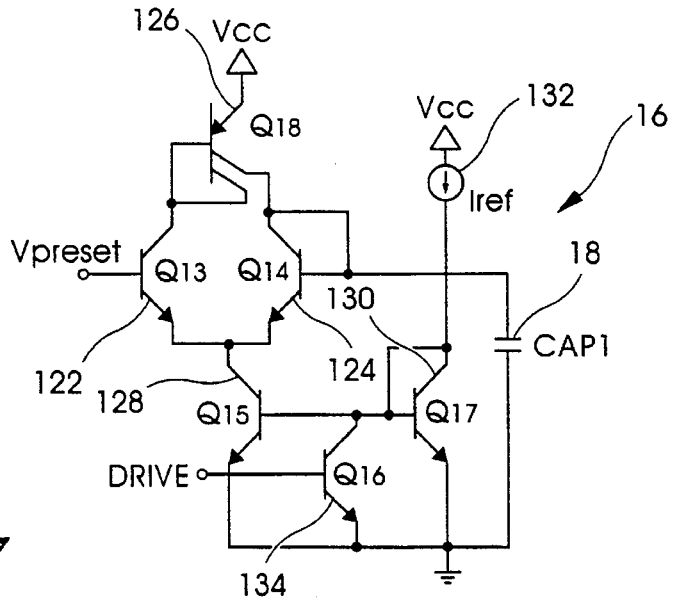
FIG. 7 is a schematic diagram of the Capacitor Voltage Preset circuit shown in FIG. 1.

Referring now to FIG. 7, a preferred embodiment of capacitor voltage preset circuit 16, wherein the voltage Vpreset is provided by reference voltage generator 12 as previously discussed, is shown. Preferably capacitor voltage preset circuit 16 comprises a voltage follower circuit having NPN transistors Q13 122 and Q14 124 connected as a differential pair. PNP transistor Q18 126 is a dual collector transistor with one collector tied to its base and to the collector of Q13. The remaining collector of Q18 is tied to the base and collector of diode connected transistor Q14 which is, in turn, connected to capacitor 18. The emitters of Q13 and Q14 are both connected to the collector of NPN transistor Q15 128. Diode connected NPN transistor Q17 is connected to Q15 to form a current mirror therebetween, and is further supplied a reference current via reference current generator 132. Preferably, reference current generator 132 is identical to reference current generators 72 and 92 previously described. Finally, NPN transistor Q16 134 is connected between the base of Q15/Q17 and ground, and has a base connected to the drive signal (35 of FIG. 2).

With reference to FIGS. 2 and 7, the operation of capacitor preset voltage circuit 16 will now be described in detail. Prior to receiving a drive signal (t<0 in FIG. 2), drive 35 is a logic low level. As such, Q16 is turned off so that the current Iref flowing through Q17 is mirrored to Q15. Current flowing through Q15 enables the differential pair Q13/Q14 so that the voltage appearing at the base of Q13 122 is impressed upon the base of Q14 124, and thereby on the capacitor 18. Thus, for t<0, the voltage Vcap 34 across capacitor 18 is maintained by circuit 16 at a voltage substantially equal to Vpreset.

At t=0, drive 35 switches to a logic high state, thereby turning on Q16 134. As long as Q16 134 is turned on, the current mirror composed of Q15/Q17 is disabled, thereby disabling the differential pair Q13/Q14. Disabling the differential pair Q13/Q14 then forces the base/collector of Q14 into a high impedance state, effectively disconnecting the voltage Vpreset from capacitor 18. The high impedance state is maintained until drive 35 switches back to a logic low level.

Referring once more to FIG. 2, the timing diagram shown therein represents the operation of ignition system protection circuit 10 with all circuit components set to the values described above. As shown in the FIG., for Vbatt=14 volts, Vref2=3.8 volts, Vpreset=2.9 volts, Vref1=2.6 volts, and the lockup time is approximately 70 milliseconds.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An ignition system protection circuit comprising:

a first circuit responsive to a variable level power input voltage to provide a first reference signal varying as a function of said variable level power input voltage;

a second circuit providing a fixed second reference signal greater than said first reference signal;

a third circuit responsive to an ignition coil energizing signal, said first reference signal and said second reference signal to provide a periodic clock signal having a frequency dependent upon the difference between said second reference signal and said first reference signal; and a fourth circuit responsive to a number of said clock signals to provide an ignition coil deenergizing signal.

2. The ignition system protection circuit of claim 1 wherein said variable level power input voltage corresponds to a battery voltage varying between a minimum battery voltage and a maximum battery voltage.

3. The ignition system protection circuit of claim 2 wherein said first circuit includes a first resistor connected at one end to said battery voltage and at an opposite end to a parallel combination of a second resistor in series with a diode connected first transistor; and a second transistor connected to said first transistor to form a current mirror therebetween.

4. The ignition system protection circuit of claim 3 wherein said first reference signal is proportional to current flowing through said second resistor;

and wherein the current flowing through said second transistor causes said first reference signal to vary non-proportionally to said varying battery voltage.

5. The ignition system protection circuit of claim 4 wherein the size of said second transistor relative to said first transistor defines a ratio N;

and wherein said ratio N, said first resistor and said second resistor are sized such that said first reference signal is a first percentage of said minimum battery voltage and a second percentage of said maximum battery voltage.

6. The ignition system protection circuit of claim 5 wherein said second resistor comprises two series connected resistors defining a node therebetween;

and wherein said first reference signal corresponds to the voltage at said node.

7. The ignition system protection circuit of claim 1 wherein said first and second reference signals have substantially identical temperature coefficients such that the difference between said first and second reference signals remains substantially constant for a given power input voltage over a range of temperature.

8. The ignition system protection circuit of claim 7 wherein said second circuit includes a current source, independent of said variable level power input voltage, connected in series with a number of diode connected transistors and a first resistor;

and wherein said second reference signal is proportional to the current flowing through said series connection.

9. The ignition system protection circuit of claim 8 wherein said current source provides a current Iref according to the equation $Iref=Vt*1n(K)/R2$;

wherein Vt is defined as a thermal voltage proportional to temperature, K is a constant, and R2 is a second resistor included within said current source.

10. The ignition system protection circuit of claim 9 wherein the connection of said current source with said number of diode connected transistors and said first resistor defines a node;

and wherein said second reference signal corresponds to the voltage at said node.

11. The ignition system protection circuit of claim 10 wherein said first and second resistors are sized to provide said second reference signal having a temperature coefficient substantially identical to that of said first reference signal.

12. An ignition system protection circuit comprising:

a first circuit responsive to a variable level power input voltage to provide a first reference voltage functionally related to said variable power input voltage;

a second circuit providing a fixed second reference signal greater than said first reference voltage;

a third circuit responsive to a periodic clock signal to provide a correspondingly periodic charging and discharging current;

a capacitor responsive to said periodic charging and discharging current to provide a correspondingly periodic increasing and decreasing capacitor voltage;

a first comparator responsive to said first reference voltage and said capacitor voltage to provide a first switching signal;

a second comparator responsive to said second reference voltage and said capacitor voltage to provide a second switching signal;

a fourth circuit responsive to said first and second switching signals to provide said periodic clock signal to said third circuit, said periodic signal having a frequency dependent upon the difference between said second reference voltage and said first reference voltage; and a fifth circuit responsive to a number of said periodic clock signals to provide an ignition coil deenergizing signal.

13. The ignition system protection circuit of claim 12 further including a voltage preset circuit maintaining a preset voltage on said capacitor, said voltage preset circuit being responsive to an ignition coil energizing signal to disable said voltage preset circuit from maintaining said preset voltage on said capacitor, thereby permitting said capacitor to be responsive to said periodic charging and discharging current.

14. The ignition system protection circuit of claim 13 wherein said voltage preset circuit comprises a voltage follower circuit having an input receiving a preset voltage and an output connected to said capacitor, said voltage preset circuit being responsive to said ignition coil energizing signal to switch said output to a high impedance state.

15. The ignition system protection circuit of claim 14 wherein said preset voltage is provided by said first circuit;

and wherein said preset voltage is proportionally greater than said first reference voltage.

16. The ignition system protection circuit of claim 12 wherein said third circuit includes a first current source responsive to an ignition coil energizing signal to provide said charging current to said capacitor, and a second current source responsive to said first current source and to said periodic clock signal to draw a current substantially equal to twice said charging current from said capacitor.

17. The ignition system protection circuit of claim 16 wherein said first current source includes a reference current source connected to the parallel combination of a first diode connected transistor connected in series with a first resistor; and a second resistor connected in series with a second diode connected transistor;

and wherein said charging current is established in the series connection of said second resistor and said second diode connected transistor.

18. The ignition system protection circuit of claim 17 wherein said first current source further includes a current mirror connected to said second diode connected transistor and to said capacitor to thereby provide said charging current to said capacitor.

19. The ignition system protection circuit of claim 17 wherein said reference current source provides a current Iref according to the equation Iref=Vt*1n(K)/R3;

wherein Vt is defined as a thermal voltage proportional to temperature, K is a constant, and R3 is a third resistor included within said current source.

20. The ignition system protection circuit of claim 19 wherein said second and third resistors have substantially identical temperature coefficients;

and wherein said first resistor has a negligible temperature coefficient relative to the temperature coefficient of said second and third resistors.

21. The ignition system protection circuit of claim 20 wherein the resistance of said first resistor is adjustable to thereby adjust the magnitude of said charging current.

22. The ignition system protection circuit of claim 12 wherein said fourth circuit is further responsive to an ignition coil energizing signal to provide said periodic clock signal in an initially known state.

23. The ignition system protection circuit of claim 22 wherein said fourth circuit is a flip-flop circuit;

and wherein said fifth circuit is a counter circuit.

24. A method of protecting an automotive ignition system from prolonged conduction of current from a variable-power voltage source through an ignition coil of the system due to a prolonged ignition coil energizing signal, the method comprising the steps of:

(1) sensing the ignition coil energizing signal;

(2) delaying a variable time period after sensing the ignition coil energizing signal, said variable time period increasing in duration as the voltage from the variable-power source decreases, wherein step (2) further includes the steps of:

(2)(a) generating a first reference signal corresponding to a function of the voltage of the variable-power voltage source;

(2)(b) generating a fixed second reference signal greater than said first reference signal;

(2)(c) generating a periodic clock signal having a frequency that increases as the difference between said second reference signal and said first reference signal decreases; and (2)(d) delaying a time period equivalent to the occurrence of a predetermined number of clock signals; and (3) generating an ignition coil deenergizing signal at the end of said variable time period to inhibit further conduction of current from the variable-power source through the ignition coil of the system.

* * * * *